US005184989A

United States Patent [19]

Stanec

[11] Patent Number: 5,184,989

[45] Date of Patent: Feb. 9, 1993

[54] PHYSICAL EXERCISE SYSTEM USING SKIS

[76] Inventor: George Stanec, 15 Secor Rd., Scarsdale, N.Y. 10583-7111

[21] Appl. No.: 791,457

[22] Filed: Nov. 13, 1991

[51] Int. Cl.[5] ..... A63B 22/00; A63B 69/18

[52] U.S. Cl. ..... 482/71; 482/51

[58] Field of Search ..... 482/71, 51, 79, 148

[56] References Cited

U.S. PATENT DOCUMENTS 2,964,315 12/1960 Dinning ..... 482/71

4,802,856 2/1989 Olson ..... 482/71

*Primary Examiner*—Stephen R. Crow

*Attorney, Agent, or Firm*—Eliot S. Gerber

[57] ABSTRACT

A physical exercise system uses conventional downhill or cross-country skis and poles in a skiing exercise system. An ski holder (elevated structure) is attached to the end of each of the pair of skis and a plug is attached to each of the pair of ski poles. The exercise may be performed in the living room environment on a residential carpet.

When the skis are moved from a generally horizontal exercising position to a vertical position, for storage or display, the flat base of the ski holder provides for stable upward display and storage of the skis.

An exercise method is disclosed which may provide the skier five aerobic points a day in a single twelve-minute exercise period.

14 Claims, 4 Drawing Sheets

PHYSICAL EXERCISE SYSTEM USING SKIS

FIELD OF THE INVENTION

The present invention relates to physical exercise equipment, systems and methods.

BACKGROUND OF THE INVENTION

At the present time a number of physical exercise systems attempt to simulate one or more conditions of downhill or cross-country skiing. For example, the Nordic Track (TM) uses both leg and arm motion to simulate cross-country skiing. Generally, such devices are expensive and occupy considerable floor space, which may be a problem in a crowded house or apartment.

Velocity and acceleration vectors, the basic concepts of physics, may be applied to skiing mechanics. Acceleration is the dominant factor in relation to the skier's sensory system. The magnitude and direction of the acceleration vector acting on the body of the skier, when skiing downhill, is felt by the skier's muscle memory system and not seen by his eyes. However, the velocity is generally seen by the eyes, but not felt. The acceleration felt by a skier is also the dominant factor the skier enjoys when skiing downhill. Having this in mind, no attempt is made to describe the invention as a downhill skiing simulator; but rather it provides a general exercise system which may be especially beneficial in training for skiing since it exercises and tones many of the same muscles that are used in skiing.

A number of downhill skiing simulators which may be used by skiers are shown in prior art. For example, U.S. Pat. No. 4,880,226 discloses a device which does not create for the skier the feeling of acceleration similar to a feeling when the skier is on real snow and slope. In general, the repetitive acceleration cycles created mechanically by downhill skiing simulators force the skier to balance and coordinate his response to counter the simulated acceleration output. This type of simulator, and the skier's responses to its acceleration output, only introduce and reinforce bad skiing habits which may be unrecognizable to the skier until the skiier confronts real snow and slope conditions.

OBJECTIVES OF THE INVENTION

It is an objective of the present invention to provide downhill skiing exercise equipment which does not have to be installed and disassembled after each use.

Another objective of the present invention is to provide downhill skiing exercise equipment in which all the exercises are initiated and controlled by the skier.

Another objective the present invention is to provide the skier with an opportunity to achieve five aerobic points in twelve minutes of exercise activity on skis converted to downhill skiing exercise equipment. As long as the skier earns 30 aerobic points a week in any combination of activities, the fitness and strength of all muscle groups involved in downhill skiing can be maintained. If the skier uses this invention as a primary source of exercise activity, then the minimum time needed will be 12 minutes per day six times per week.

Furthermore, it is an objective of the present invention to provide the skier with mean for the simultaneous storage and aesthetic display of the skis in a living room. Thus, the easy accessibility of the skis for exercise is combined with the skier's enjoyment of the artistic view of the skis during all seasons of the year.

SUMMARY OF THE INVENTION

In the present invention the skier converts conventional downhill or cross-country skis and ski poles to downhill skiing exercise equipment by attaching ski holders (elevated structures) to skis and plugs to each of the ski poles.

The user's own skis and ski poles are converted into skiing exercise equipment. The downhill skiing exercise equipment maintains and develops the strength of all muscle groups involved in downhill skiing. Furthermore, when the skis, which are converted to exercise equipment, are moved to a vertical position, the flat base of the ski holder elevated structure provides for stable upward display and storage of the skis.

BRIEF DESCRIPTION OF THE DRAWINGS

Other objectives of the present invention will be apparent from the following detailed description of the inventor's presently known best mode of practicing the invention, taken in conjunction with the accompanying drawings.

In the drawings.

DETAILED DESCRIPTION OF THE PREFERRED EMBODIMENTS

Figure 1:
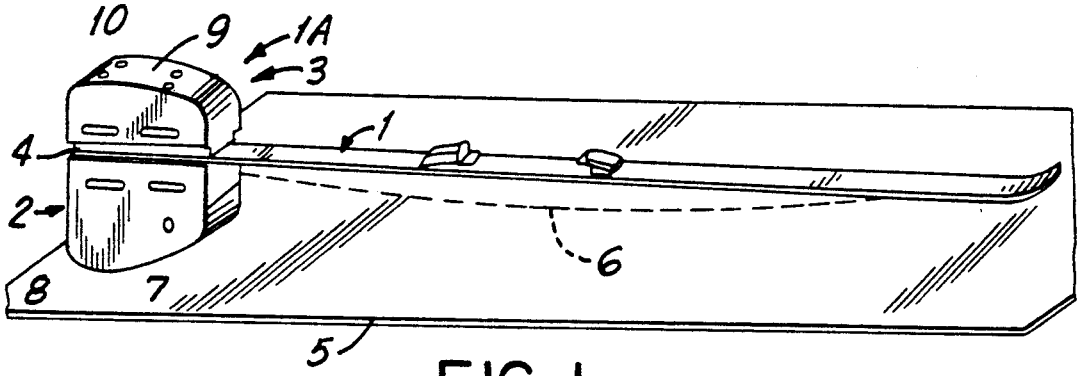
FIG. 1 is a perspective view showing one ski as used in the downhill skiing exercise equipment of the present invention.

Turning now to the drawings, FIG. 1 shows one ski 1 of a pair of skis firmly compressed between the bottom portion 2 of the ski holder 1A (elevated structure) and the top portion of the ski holder (elevated structure) generally designated by reference number 3. The two portions 2 and 3 form a slot identified by reference number 4. The function of slot 4 is described in connection with FIG. 7.

The unloaded ski 1 (without anyone on the ski) rests freely on a floor carpet, identified by reference number 5. The ski 1 when loaded (by weight of the skier) flexes, as shown by dashed line 6. At the same time ski holder 1A is compressed, as shown by dashed line 8, and simultaneously it turns into its loaded position, indicated by dashed line 7. The movement to the loaded position is smooth because the ski holder 1A is made of high-density foam which absorbs the shocks resulting from exercise and distributes the shocks to the skis and floor.

The top face of the top portion 3, identified by reference number 9, during exercise activities is in direct contact with a portion of the skier's lower back. The elevation (height) of face 9 from the floor carpet 5 is identified by arrow reference number 10. The elevation 10 serves as an indicator of the intensity of the exercise activities. Generally the higher the elevation 10 the lower the intensity of the exercise activities, and in reverse, the lower elevation 10 brings out the higher intensities of the exercise activities.

Figure 2:
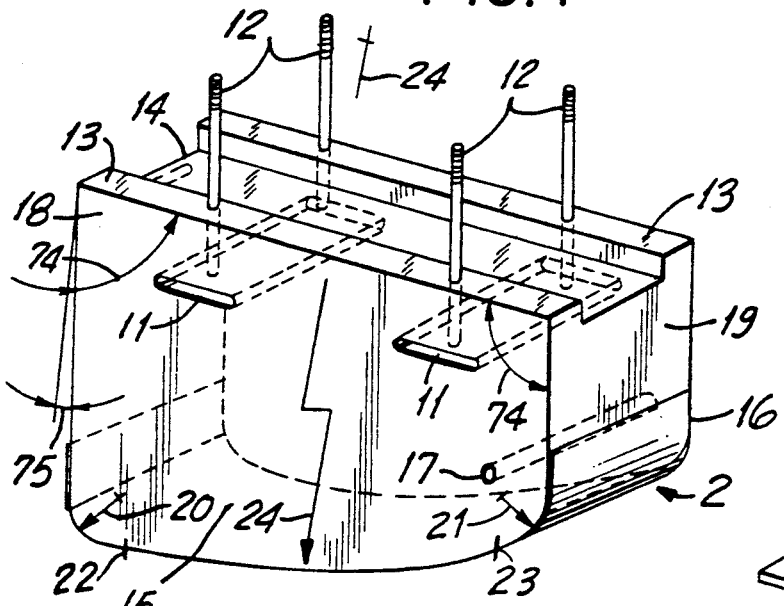
FIG. 2 is a perspective view of the bottom part of the ski holder (elevated structure)

FIG. 2 is a perspective view of the bottom portion of the ski holder, generally designated by reference number 2. The bottom portion 2 has horizontal openings for compression plates identified by reference number 11. Four bolts, identified by reference number 12, are provided for compression of the ski between the bottom portion 2 and top portion 3. The bolts 12 protrude the plane, identified by number 13, down to the compression plates 11 to which they are attached and secured in position by threaded holes. The serrated slot 14 may be used for certain brands of the ski to prevent the ski from moving sideways during the exercise activities.

The reference number 15 shows the sheet portion of the ski holder which is in direct contact with the carpeted floor. This sheet portion of the ski holder consists of a sheet, identified by reference number 16, secured by standard means, such as an adhesive, to the ski holder body. Its function is to provide a low coefficient of friction to obtain an easy sliding motion on the carpeted floor during the exercise activities.

At the present time the body of the ski holder preferably is formed of chemically cross-linked polyethylene high-density plastic resin foam manufactured by Sentinel Foam Products under the trade name "Microcell" (TM) foam. In general, the preferred foam material has sufficient mechanical strength and resiliency and is lightweight. It is able to absorb the shocks resulting from the exercise activities, so that the skier's ligaments and joints are not exposed to undue stress. When the ski is compressed between the ski holder top and bottom portions, the foam material has to provide good non-slipping connection to the ski.

At the present time the preferred material for low coefficient of friction sheet 16 is a polyethylene sheet manufactured by Ain Plastics. The properties of the sheet 16 are high-tensile strength, abrasive resistance and low friction. However, other means to provide low friction to sheet portion 15 are within the scope of this invention; for example, a dry lubricant may be used.

The reference number 17 shows a horizontal opening in the ski holder. The function of opening 17 is described in connection with FIG. 7.

Preferably the length of the ski holder is about four times the width of the ski it is adapted to hold. The height of base side 18 is preferably about three times the width of the particular ski it is adapted to hold. The height of the opposite low side, identified by reference number 19, is preferably about two times the width of that particular ski. The base side 18 and the low side 19 are not parallel. This is shown by the right angle identified by reference number 74 and an angle, equal to 2°, identified by reference number 75. The function of angle 75 is described in connection with FIG. 7.

The shape of the structure identified by reference number 15 is established by radius 20 with the limit identified by vertical dash 22 and by radius 21 with the limit identified by vertical dash 23. The limits shown by dashes 22 and 23 also serve as limits for an arc identified by reference number 24.

However, the size and shape of the bottom may vary according to the specific application of the present invention. Different sized ski holders are useful for various intensities of exercise activities.

Figure 3:
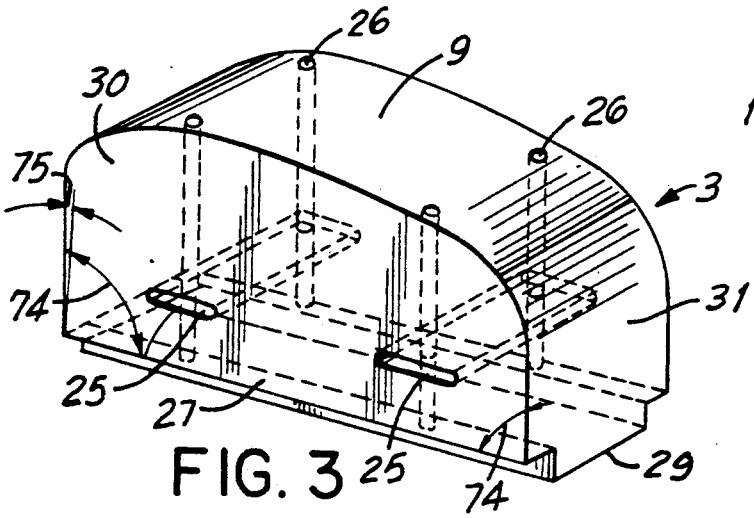
FIG. 3 is a perspective view of the top part of the ski holder (elevated structure)

FIG. 3 is a perspective view of the top portion 3 of the ski holder. It has two horizontal openings for compression plates, identified by reference number 25, and four vertical openings, identified by reference number 26. The function of the openings 26 from the ski side, identified by reference number 27, is to allow the bolts 12 to pass through the compression plates 25. The function of the openings from the side of top face 9 is to allow the nuts, identified by reference number 28, to be reached by a tube key. Turning the nuts compresses the ski between the top and bottom portions of the ski holder. The serrated extension, identified by reference number 29, provides a non-slipping connection between the top and bottom portions.

The top face 9 is in direct contact with the skier's low back during the exercise activities. Preferably, the material of the top face 9 is the same as the material of the bottom face.

Preferably the length of the ski holder is four times the width of the user's ski. The height of the base side 30 is two times the width of that ski. The height of opposite low side 31 is one-and-a-half times the width of that ski. The width of the ski holder is two times the width of the ski. Similarly to the bottom portion 2, the base side 30 and the low side 31 are not parallel.

The shape of the ski holder top face 9 is established the same way the shape of sheet bottom 15. Also, the length and width of the top elevated portion 3 is the same as of the bottom portion 2.

Assuming the width of the ski is the same as for bottom portion 2, the base side 30 is 5.50 inches and the low side 31 is 4.125 inches.

Similarly, the size and shape may vary according to specific applications of the present invention.

Figure 4:
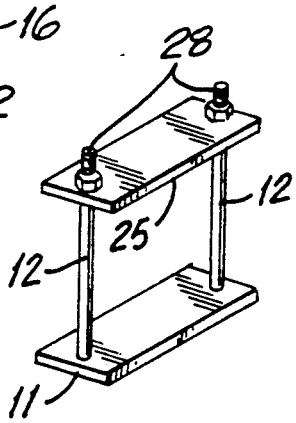
FIG. 4 is a perspective view of a compressing plate assembly.

FIG. 4 shows in detail a perspective view of the compressing plate assembly. For the purpose of clarification, the compression plate assembly is removed from the ski holder. The assembly consists of compressing plates 11 and 25, bolts 12 (immobilized in plate 11 by standard means) and nuts 28.

When the two nuts 28 are turned down, the compressing plate 25 moves freely on the bolts 12 and engages the top and bottom portions to compress the ski between them.

The preferred material for the bolts and nuts is stainless steel and the preferred material for the plates is aluminum.

Figure 5:
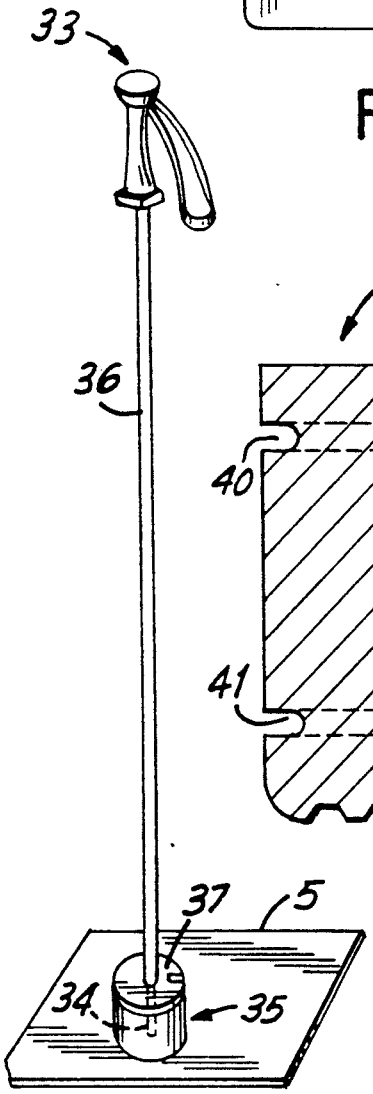
FIG. 5 is a perspective view of a ski pole as used in the downhill skiing exercise equipment of the present invention.

FIG. 5 shows in detail a standard (conventional) ski pole, generally designated by reference number 33. The ski pole is converted into an exercise pole by piercing the tip 34 into the pole plug, generally designated by reference number 35. The material of the pole plug is preferably identical to the material of the ski holder 1A.

The force applies to the pole 33, by the hands of the skier involved in exercise activities, is transferred through the ski pole shaft 36 to the ski pole basket 37. The ski pole basket 37 distributes the force to the circular area of cylinder-like pole plug 35. The microcell cross-linked polyethylene foam absorbs the shocks generated by the exercise activity and dissipates them into the floor carpet 5.

Figure 6:
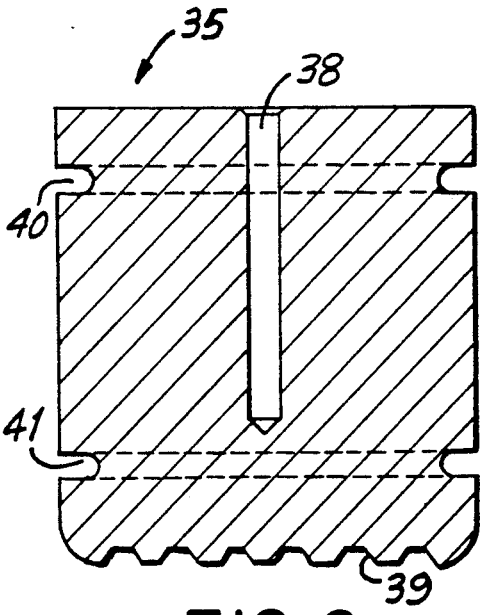
FIG. 6 is an enlarged cross-section of the ski pole plug structure.
Figure 11:
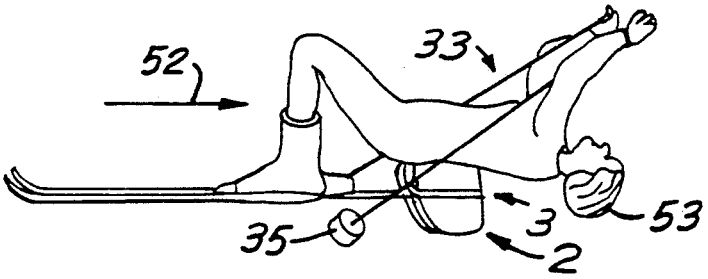

FIG. 6 shows an enlarged cross-section of the pole plug 35. In the center on the top of the cylindrical pole plug 35 is a vertical opening, identified by reference number 38. The diameter of opening 38 is only half of the diameter of the ski pole tip 34 and the depth of opening 38 is equal to the length of ski pole tip 34 up to ¾ of the height of the pole structure. A significant force is required to engage the ski pole tip 34 into pole plug 35 because the diameter of the pole tip is larger than the diameter of the ski plug opening. Preferably the height of the pole plug is equal to the diameter of the pole plug, or higher, to satisfy the condition of the depth of the vertical opening to be no more than ¾ of the height of the pole tip. The bottom area of the pole plug has a serrated surface, identified by reference number 39. This is to provide a good non-slipping contact with the carpeted floor. The circular notch, identified by reference numbers 40 and 41, is provided to further improve the non-slipping contact when the pole plug engages with the floor at a sharp angle, as shown in FIG. 11.

Figure 8:
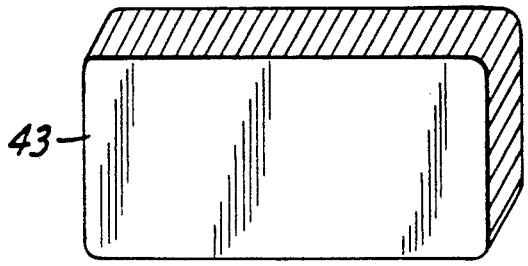
FIG. 8 is a perspective view of a connecting plate for connection of two ski holders (elevated structures)
Figure 7:
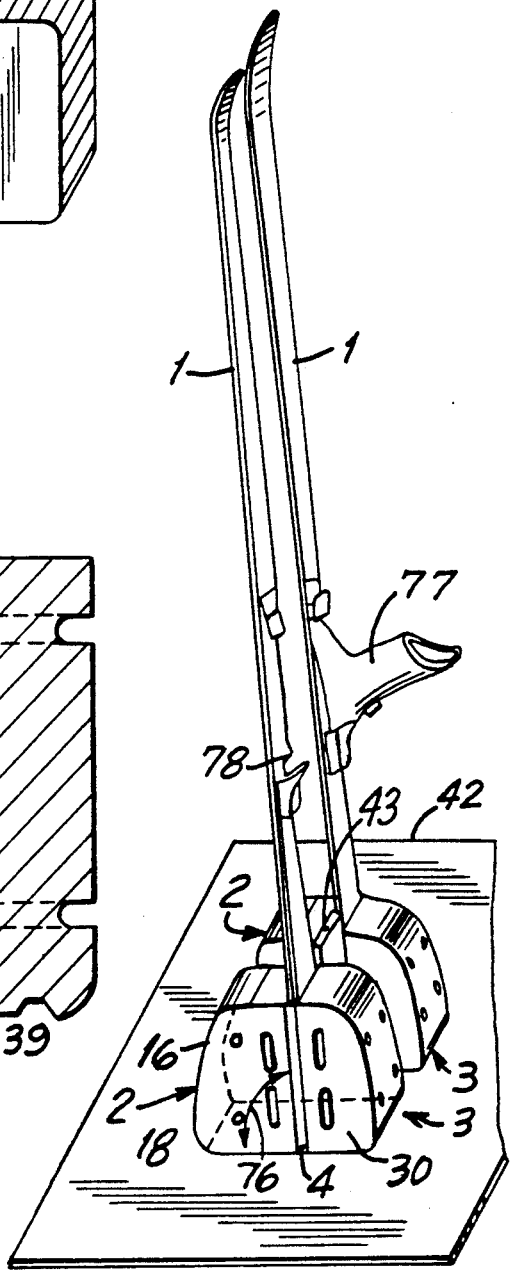
FIG. 7 is a perspective view of a pair of skis as used in the downhill skiing exercise equipment, the equipment being shown in a self-standing upward display and storage position.

FIG. 7 shows a pair of skis converted to downhill skiing exercise equipment in a standing upward display position. The base side 18 and 30 form one substantially flat base resting on floor 42. Each ski separately is self-standing and stable in its upward display position. In order to further increase stability, a connecting plate, identified by reference number 43, connects two ski holders together thus doubling the size of the flat base and increasing the stability of the pair of skis. The means of connection is provided by compression of connecting plate 43 into slot 4 formed on each ski holder. The connecting plate is shown in FIG. 8.

Figure 9:
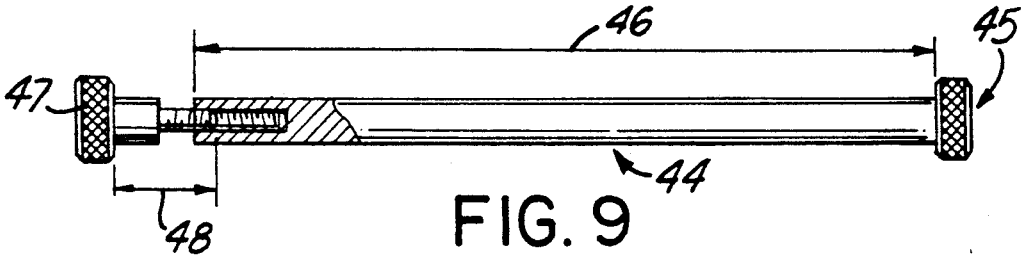
FIG. 9 is a side plan view, partly broken-away, showing a connecting rod for an alternative connection of two ski holders.

Horizontal opening 17 is provided for alternating means to connect a pair of ski holders, by a connecting rod, generally designated by reference number 44, and shown in FIG. 9.

The angle 76 shows the position of the skis toward the floor and it is a result of subtracting the angle 74 from angle 75 which is 88 degrees. The function of the specific ski angle 76 is to stabilize the self-standing position of the ski by accounting for the weight of ski boot 77.

The ski boot, identified by reference number 77, is shown resting on unlocked heel portion of the ski binding, identified by reference number 78.

FIG. 8 shows a connecting plate 43 whose preferred material is acrylic. The plate has all its sharp edges rounded. Assuming the width of a ski is equal to 2.75 inches, then the length of plate 43 is equal to 5.5 inches, which is two times the width of the ski, and the height of the plate 43 is equal to 2.75 inches which is the width of the ski. The thickness of the connecting plate is 1.5 thicker than the width of slot 4.

FIG. 9 shows a connecting rod, generally designated by reference number 44, consisting of a rod with female thread, identified by reference number 45, and a rod with male thread, identified by reference number 47. The preferred material of the rods is aluminum.

Assuming the width of the ski is 2.75 inches, then the preferred dimension 46 is 9.625 inches which is 3.5 times the width of the ski and the preferred dimension 48 is 1.65 inches which is 0.6 times the width of the ski.

DESCRIPTION OF THE EXERCISING METHOD

In downhill skiing, the magnitude and change in direction of the acceleration vector acting on the body of the skier, demands compensatory action from the entire muscle system. The downhill event is not of long duration, still the body is in constant isometric contraction while it is being performed and is considered a high intensity activity. Generally, the skier is involved in the high intensity activity only on the trail going down from the top to the bottom of the hill. For example, the average time of an average trail is in the range of 1 to 2 minutes. The time assumption for one day of high activity of the skier is 12 minutes. The rest of the day the skier is involved in low intensity activities like standing in line waiting for the lift, etc.

In this invention, to develop a systematic exercise on skis converted to downhill skiing exercise equipment, the method of aerobic point system is used. In this system the activities are categorized according to intensity and time, and awarded points. The goal is to earn at least 30 points a week. As long as 30 aerobic point a week are earned, the downhill skier's muscle system can be maintained for the next skiing season. In order to categorize the method of this invention into the family of aerobic exercises, the following components of the aerobic method are established and described.

THE ACTIVITIES: The activities of one cycle are shown and described in FIGS. 10 through 13. The intention of these activities is to exercise all the muscle groups involved in downhill skiing. Numerous other activities performed in cycles can be introduced. However, the cycle shown is used to award the aerobic points by means of aerobic equations and experimental measurements.

THE INTENSITY OF EXERCISE: The intensity of exercise is defined as the number of cycles in given intervals. The result of experimental equations established 60 cycles as a limit in intervals of 12 minutes.

TIME: Time of 12 minutes in accordance with actual high intensity downhill skiing activities is used in experimental equations.

POINTS AWARDED: Points awarded experimentally in connection with aerobic equations for the method disclosed in this invention is five points, satisfying the intensity of exercise of 60 cycles in a time interval of 12 minutes or less.

The goal of 60 cycles in 12 minutes is the skier's final level of exercise and will be attainable in progressive steps, starting with 20 or 30 cycles a day. Based on the skier's athletic abilities, a reasonable time to reach the final level will be four weeks, increasing 10 cycles in one week. To reach the goal of 60 cycles in 12 minutes the skier has to be in excellent condition.

FIGS. 10, 11, 12 and 13 are presented to aid the description of activities in one exercising cycle. The cycle consists of four motions acting in separate or reverse directions. The instantaneous change in direction of the motions demands quick reflexes and the weight shifts require compensatory action from the entire muscular system of the exercising skier.

Figure 10:
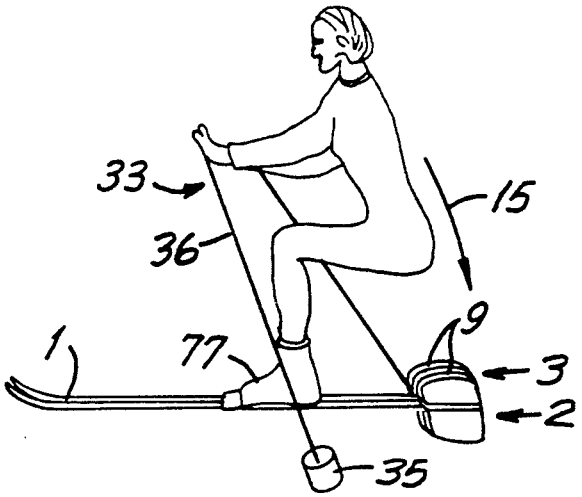
FIGS. 10 through 17 show a skier involved in exercise activity on skis and a pair of ski poles a used in the skiing exercise equipment of the present invention.
Figure 12:
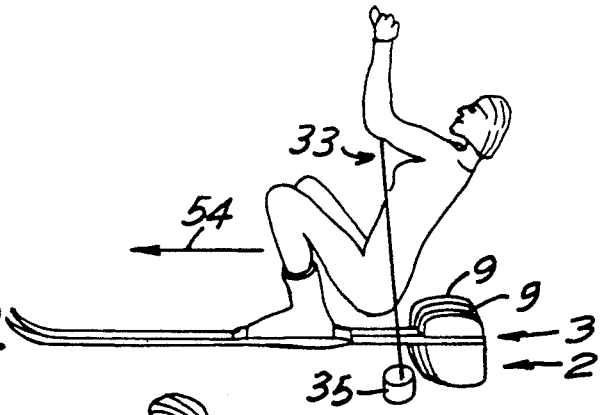
Figure 13:
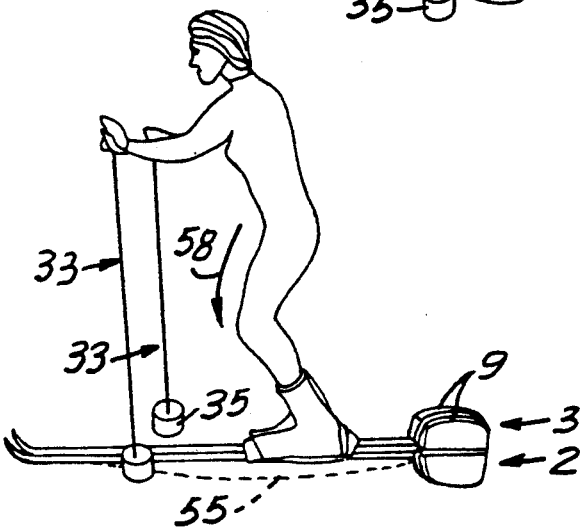

The cycle begins with down motion shown in FIG. 10 and changes into swing and slide backward motion shown in FIG. 11, which changes to push and slide forward motion shown in FIG. 12, ending the cycle by standing and swinging motion on the skis shown in FIG. 13. The duration of one cycle is in the range of 5 to 8 seconds.

The following are the notes to specific figures of the cycle, summarizing what the skier will do mostly by downhill skiing instincts. Therefore, the notes should not be viewed as instructions.

FIG. 10 shows the down motion until the skier's lower back reaches the top face 9 of the ski holder. The arrow 51 shows the direction of the motion. No force is applied to ski poles 33; the pole plugs 35 are just touching the floor to keep the skier in balance. The muscles involved are the thighs and abdominal muscle groups. The down motion ends when the body weight shifts to the arms and palms of the skier.

FIG. 11 shows the swing and slide backward motion while the skier's lower back is resting on the ski holders. The arms and palms firmly hold the ski poles 33 and use the pole 35 as a pivot point of body weight and provide the sliding force for backward motion, indicated by arrow 52. FIG. 11 shows the ski poles in a sharp angle to the floor and the back of head 53 at the elevation of the top face 9. Maximum force is applied to the ski poles and the plugs 35 are in firm contact with the floor. All upper and lower body muscle groups are involved in this phase of the cycle. The backward motion ends when the skier, in a fraction of a second, changes the position of poles 33 for push and slide forward motion.

FIG. 12 shows the skier lifting his lower back from ski holder portion 3 in sliding forward motion indicated by arrow 54 in an attempt to reach the position on the floor prior to the backward slide. Maximum force is applied by arms and palms to the ski poles 33 in order to lift the body of the skier and push the skier to slide forward. The pole plugs are in firm contact with the floor. All upper and lower body muscle groups are involved in this phase of the cycle. The forward motion ends when the skier shifts the weight from arms to knees in standing position.

FIG. 13 shows the skier in the end of the cycle ready for the next cycle. Since the skier's arms release the body weight, the skier deflects the skis, shown by dashed line 55, and the knees of the skier move in direction 56 and flex the skis.

The minimum floor space for the activities as described in the above notes to FIGS. 10 through 13 is 4 feet wide and 3 feet over the length of the skis.

The preferred floor area is to be covered by standard residential carpet 1-inch high textured construction installed on standard half-inch-thick bouncy pad.

Figure 14:
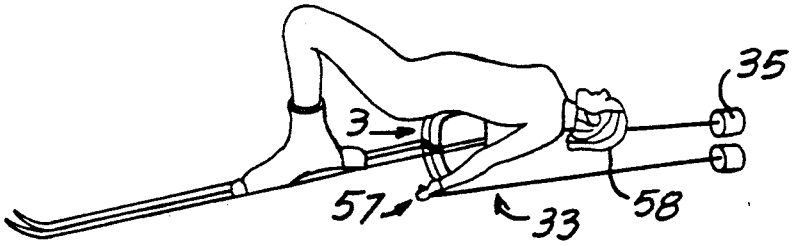

FIG. 14 shows the skier stretching on the skis converted to downhill skiing exercise equipment. In this position the hand 57, the ski poles 33 and the ski pole plugs 35 are resting on the floor. The skier's lower back is resting on the ski holder portion 3 and the back of head 58 is at the elevation of the top face 9.

Preferably the skier will stretch before and after exercise and also during the exercise when the skier is resting to recover energy for continuation of exercise activities. The skis and poles converted to exercise equipment ar excellent tools to motivate the skiers to stretch. The skier knows that just in case the abdominal muscles' strength is inadequate to lift his body weight, the ski poles 33 will help the skier return to his upright position.

Figure 15:
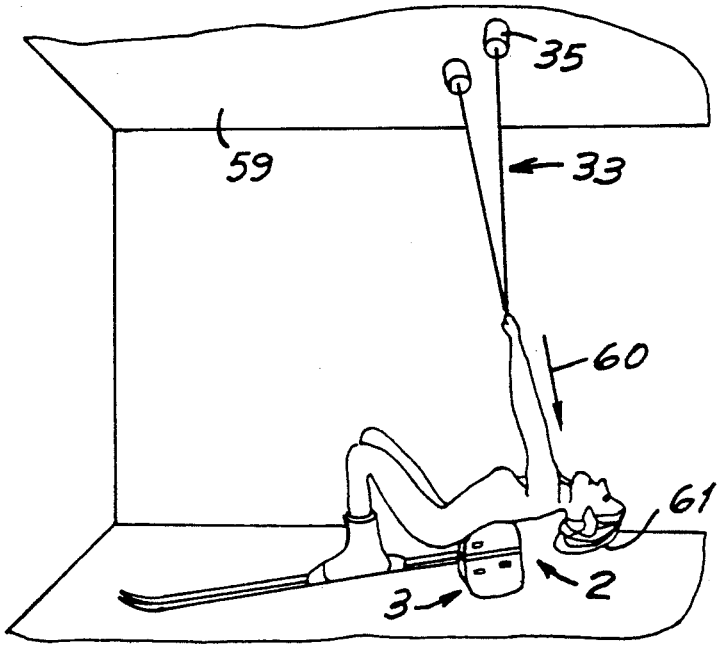

FIG. 15 shows the skier in position where the skier uses active force for stretching, as identified by arrow 60. The skier's arms through the ski pole 33 and plug 35 reach to the ceilings of the room 59. This particular way of stretching works only for room ceilings of 200 centimeters or lower. The U.S. 8-feet-high (234 cm) standard ceilings are for obvious reasons not suitable for this particular way of stretching.

Figure 16:
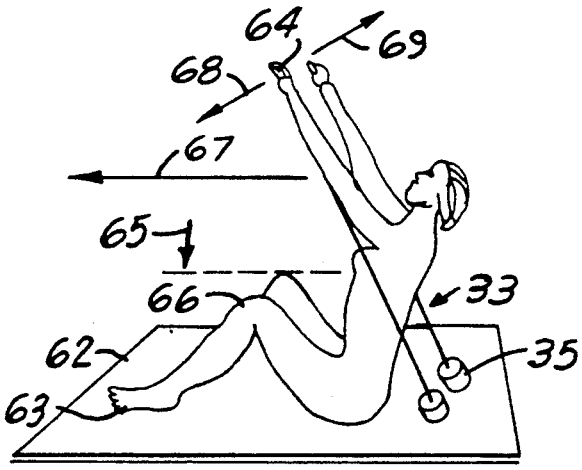

FIG. 16 shows the skier in position of the best aerobic rest, meaning the lowest consumption of oxygen is required to sustain the skier in the position shown where the skier is sitting on the about-1-inch-thick bouncy pad 62. The feet of the skier 63 are firmly planted by his heels into bouncy pad 62. The hands 64 are held above the level of the skier's heart, as identified by arrow 65 holding the ski poles 33 and through plugs 35 provide firm contact with bouncy pad 62. The knees identified by reference number 66 are at the level of the heart or slightly above.

The skier, using every moment of available time for stretching and relaxation exercise, has an unrestricted view, for example, to watch TV, as identified by arrow 67. By moving the hands 64 in the directions indicated by reference numbers 68 and 69, the skier engages in soft stretching exercises. For this activity the pole plugs 35 provide the pivot points. To sustain the stretching activities the skier's cardiac output is functioning at the lowest capacity.

Figure 17:
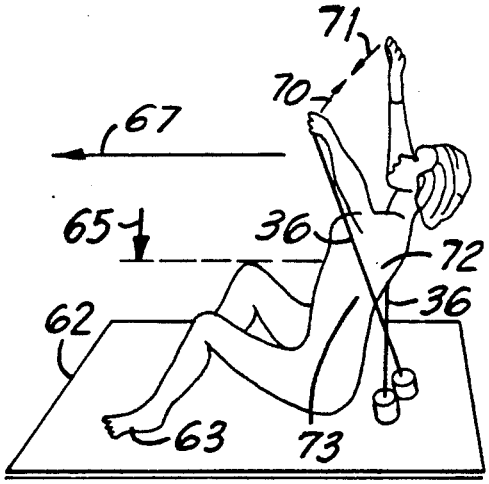

FIG. 17 shows the skier in the same position as in FIG. 16, but the pole shafts 36 are crossed behind the lower back of the skier. When hands 64 move in the direction shown by arrows 70 and 71, the pole shafts 36 roll over the side portion of the skier's back, as identified by reference numbers 72 and 73. In general, the pole crossings improve the best aerobic rest sitting position of the skier.

I claim:

1. A physical exercise system comprising a left ski holder and a right ski holder, each ski holder adapted to removably hold one ski of a pair of skis proximate an end of said one ski, the other end of said ski supported on a floor; each ski holder including:

(a) a top member adapted to be positioned on top of the held ski;

(b) a bottom member having a top face and an arcuate bottom face and adapted to be positioned under the held ski;

(c) attachment means to bring the top member removably connected to the bottom member with the ski clamped therebetween and on the top face of the bottom member; and (d) sliding means on said bottom face adapted to permit the ski holder to slide on a floor.

2. A physical exercise system as in claim 1 wherein the top member and bottom member are molded of high density plastic resin foam.

3. A physical exercise system as in claim 1 wherein the top face of the bottom member has an elongated groove therein adapted to seat the width of a ski therein.

4. A physical exercise system as in claim 1 wherein said sliding means is a sheet of low-friction plastic resin material adhered at the bottom face of said bottom member.

5. A physical exercise system as in claim 1 wherein said bottom member has a front face and a back face, said bottom member being curved between said front face and said bottom face and having said sliding means covering said curve.

6. A physical exercise system as in claim 1 and further including a pair of pole plug means, each pole plug means being adapted to fit on the pointed end of a ski pole.

7. A physical exercise system as in claim 6 wherein each of said pole plug means comprises a plug member having a flexible bore therein adapted to grasp the pointed end of a ski pole.

8. A physical exercise system as in claim 7 wherein each of said plug members is of a high density plastic resin foam.

9. A physical exercise system as in claim 4 wherein the height of the bottom member from said bottom face to said top face is in the range of 3 to 8 inches and the thickness of said sheet is less than one inch.

10. A physical exercise system as in claim 1 wherein said attachment means comprises, for each ski holder, at least four threaded bolts connected to one member and at least four nuts therefor.

11. A physical exercise system including a pair of ski holders and a pair of elongated poles;

each of said ski holders including a ski holder body member and clamp means to removably clamp a ski having a top face and bottom face, said clamp means being in the ski holder body and adapted to clamp the ski proximate the rear end of the ski, the other end of said ski supported on a floor;

said body member having an arcuate bottom face and sliding means on said bottom face to reduce sliding friction of the body member on a floor.

12. A physical exercise system as in claim 11 wherein the body member has a top surface and the height of the sliding means and the body member from said bottom face to said top surface is in the range of 3 to 8 inches.

13. A physical exercise system as in claim 11 wherein the body member is formed of high density plastic resin foam and the sliding means is a sheet of low friction plastic material adhered to said body member.

14. A physical exercise system as in claim 11 wherein the body member has a rectangular bore therethrough adapted to clamp a ski therein.

* * * * *